US010031464B2

(12) United States Patent
Mori

(10) Patent No.: US 10,031,464 B2
(45) Date of Patent: Jul. 24, 2018

(54) SHEET FEEDING APPARATUS

(71) Applicant: Brother Kogyo Kabushiki Kaisha, Nagoya-shi, Aichi-ken (JP)

(72) Inventor: Hirotaka Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/422,620

(22) Filed: Feb. 2, 2017

(65) Prior Publication Data

US 2017/0227909 A1 Aug. 10, 2017

(30) Foreign Application Priority Data

Feb. 5, 2016 (JP) ..... 2016-020944

(51) Int. Cl.

| | |
|---|---|
| ***G03G 15/00*** | (2006.01) |
| ***B65H 5/06*** | (2006.01) |
| ***B65H 9/00*** | (2006.01) |
| ***G03G 15/23*** | (2006.01) |

(52) U.S. Cl.

CPC ..... *G03G 15/6529* (2013.01); *B65H 5/062* (2013.01); *B65H 9/002* (2013.01); *G03G 15/234* (2013.01); *B65H 2301/331* (2013.01); *B65H 2404/1424* (2013.01); *B65H 2801/06* (2013.01); *G03G 2215/00438* (2013.01); *G03G 2215/00586* (2013.01)

(58) Field of Classification Search

CPC .. B65H 5/062; B65H 9/002; B65H 2301/331; B65H 2404/1424

See application file for complete search history.

(56) References Cited

U.S. PATENT DOCUMENTS

| | | | | |
|---|---|---|---|---|
| 5,335,904 | A * | 8/1994 | Ryuzaki | B65H 5/062 271/236 |
| 5,624,109 | A * | 4/1997 | Tanaka | B65H 3/0669 271/10.13 |
| 7,152,858 | B2 * | 12/2006 | Lin | B65H 3/0661 271/109 |
| 8,079,589 | B2 * | 12/2011 | Kinoshita | B65H 9/006 271/242 |

(Continued)

FOREIGN PATENT DOCUMENTS

| | | |
|---|---|---|
| JP | S63-171750 A | 7/1988 |
| JP | H05-319614 A | 12/1993 |
| JP | H06-321405 A | 11/1994 |

*Primary Examiner* — Jeremy R Severson

(74) *Attorney, Agent, or Firm* — Banner & Witcoff, Ltd.

(57) ABSTRACT

A sheet feeding apparatus includes a first drive roller and a second drive roller disposed downstream of the first drive roller and configured to rotate at a peripheral speed greater than a peripheral speed of the first drive roller. The first drive roller includes a drive shaft and a roller portion. The roller portion is configured to contact the sheet and is movable relative to the drive shaft in an axial direction and a rotation direction of the drive shaft. One of the drive shaft and the roller portion of the first drive roller includes a protrusion protruding toward the other one of the drive shaft and the roller portion. The other one of the drive shaft and the roller portion of the first drive roller includes a recessed portion. The recessed portion includes a peripheral wall that defines an opening such that the protrusion is positioned in the opening.

10 Claims, 9 Drawing Sheets

(56) References Cited

U.S. PATENT DOCUMENTS

| | | | | |
|---|---|---|---|---|
| 2003/0020231 | A1* | 1/2003 | Williams | B65H 7/10 271/227 |
| 2004/0046313 | A1* | 3/2004 | Herrmann | B65H 9/002 271/226 |
| 2010/0187752 | A1* | 7/2010 | Kersey | B65H 5/062 271/264 |

* cited by examiner

SHEET FEEDING APPARATUS

CROSS-REFERENCE TO RELATED APPLICATION

This application claims priority from Japanese Patent Application No. 2016-020944 filed on Feb. 5, 2016, the content of which is incorporated herein by reference in its entirety.

FIELD OF DISCLOSURE

Aspects disclosed herein relate to a sheet feeding apparatus configured to feed a sheet.

BACKGROUND

A known sheet feeding apparatus includes a first roller and a second roller. The first roller and the second roller are different in peripheral speed and are arranged along a sheet feed direction. To reduce load changes caused by the difference in peripheral speed between the first roller and the second roller in the sheet feeding apparatus, roller portions of the first roller and the second roller are rotatable relative to their respective roller shafts.

SUMMARY

Illustrative aspects of the disclosure provide a sheet feeding apparatus to reduce fluctuations of movement of a roller in a rotation direction of the roller and an axial direction thereof.

According to an aspect of the disclosure, a sheet feeding apparatus configured to feed a sheet, includes a first drive roller and a second drive roller disposed downstream of the first drive roller. The first roller is configured to apply a feeding force to the sheet. The first drive roller includes a drive shaft configured to receive a drive force and rotate, and a roller portion having a cylindrical shape and fitted over the drive shaft. The roller portion is configured to contact the sheet. The roller portion is movable relative to the drive shaft in an axial direction and a rotation direction of the drive shaft. The second drive roller is configured to apply a feeding force to the sheet and rotate at a peripheral speed greater than a peripheral speed of the first drive roller. One of the drive shaft and the roller portion of the first drive roller includes a protrusion protruding toward the other one of the drive shaft and the roller portion. The other one of the drive shaft and the roller portion of the first drive roller includes a recessed portion, the recessed portion including a peripheral wall that defines an opening such that the protrusion is positioned in the opening. The peripheral wall of the recessed portion includes a cam surface at a forward portion of the peripheral wall in the rotation direction, the cam surface being configured to contact a side surface of the protrusion. The opening of the recessed portion has a width, parallel to the axial direction, which becomes smaller toward the forward portion of the peripheral wall in the rotation direction. The maximum width of the opening is greater than a width, parallel to the axial direction, of the protrusion. The maximum length of the opening parallel to the rotation direction is greater than a length, parallel to the rotation direction, of the protrusion.

BRIEF DESCRIPTION OF THE DRAWINGS

Reference is made to the following description taken in connection with the accompanying drawings, like reference numerals being used for like corresponding parts in the various drawings.

DETAILED DESCRIPTION

It will be understood that the following embodiments are exemplary and thus matters specifying the claimed disclosure are not limited to specific structural and functional details disclosed herein.

The embodiments are applied to an electrophographic monochrome image forming apparatus.

To facilitate understanding of the orientation and relationship of the various elements disclosed herein, the expressions "front", "rear", "top", "upper", "bottom", "lower", "right", and "left" are used to define the various parts when the image forming apparatus 1 is disposed in an orientation in which it is intended to be used.

For portions or components, which will be described with numerals, at least one is provided unless "plural" or "two or more" is specifically stated otherwise. Illustrative embodiments of the disclosure will be described with reference to the accompanying drawings.

A first embodiment will be described.

Figure 1:
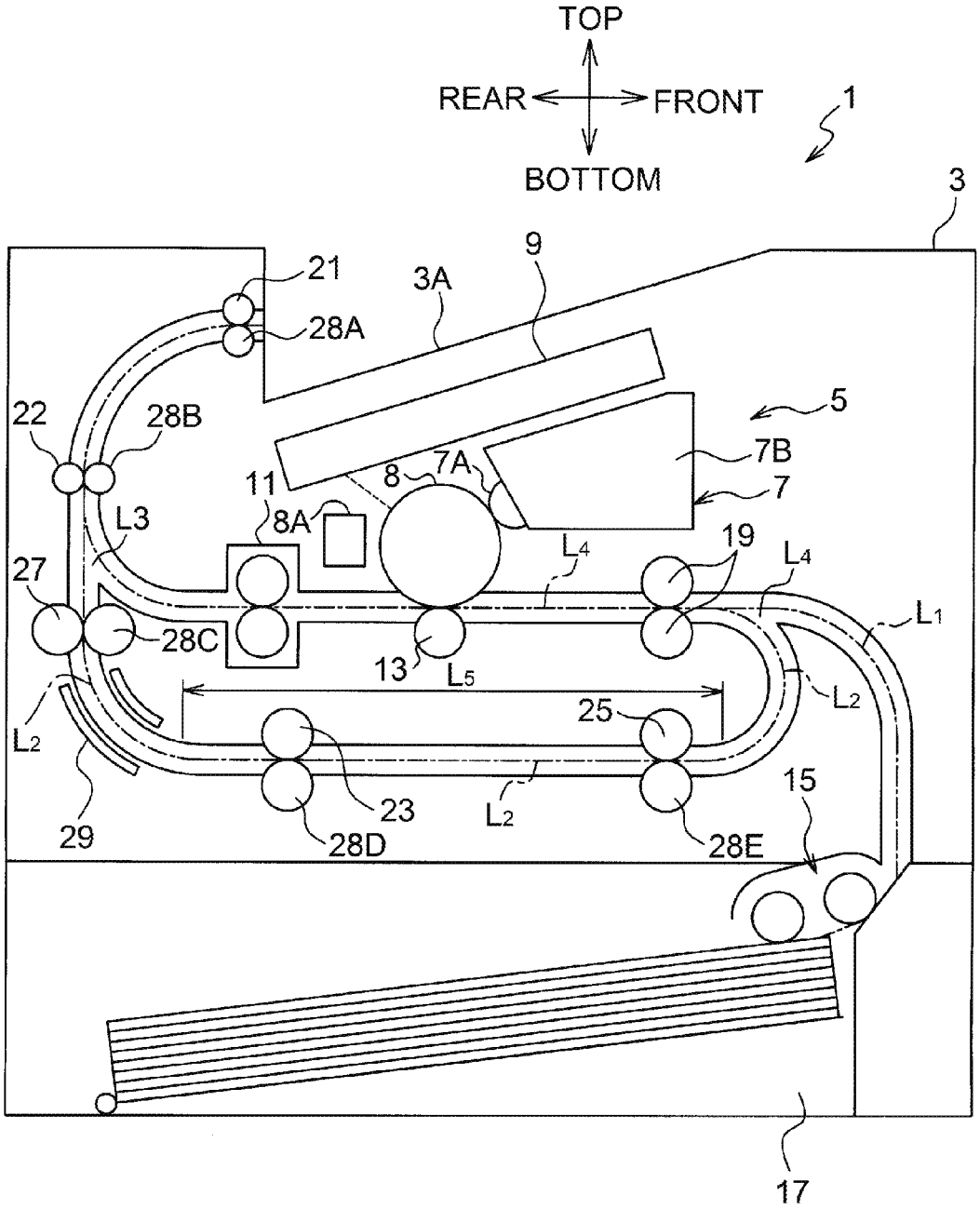
FIG. 1 is a schematic cross sectional view of an image forming apparatus according to an aspect of the disclosure.

As illustrated in FIG. 1, an image forming apparatus 1 includes an image forming unit 5 in a casing 3. The image forming unit 5 forms an image on a sheet. The image forming unit 5 includes a developing cartridge 7, a photosensitive drum 8, an exposure unit 9, and a fixing unit 11.

The developing cartridge 7 includes a developing roller 7A and a storing portion 7B. The photosensitive drum 8 carries a developer image to be transferred onto a sheet. A charger 8A charges the photosensitive drum 8. The exposure unit 9 exposes the charged photosensitive drum 8 to form an electrostatic latent image on the photosensitive drum 8.

The developing roller 7A supplies developer stored in the storing portion 7B to the photosensitive drum 8 to form a developer image on the photosensitive drum 8. A transfer roller 13 is disposed facing the photosensitive drum 8.

The transfer roller 13 transfers the developer image carried on the photosensitive drum 8 to a sheet. The fixing unit 11 is disposed downstream of the photosensitive drum 8 in a sheet feed direction to fix the developer image transferred onto the sheet. The fixing unit 11 conveys the sheet toward a sheet ejection tray 3A. The sheet ejection tray 3A receives the sheet having image thereon.

A feeder 15 is disposed upstream of the image forming unit 5 in the sheet feed direction. The feeder 15 feeds sheets received in a sheet supply tray 17, one by one, toward the image forming unit 5.

The sheet supply tray 17 is detachably attached to the casing 3. The sheet supply tray 17 is detachable from the casing 3 for refilling the sheet supply tray 17 or replacing sheets with a different type of sheets.

A pair of registration rollers 19 is disposed upstream of the photosensitive drum 8 in the sheet feed direction. The registration rollers 19 correct the orientation of a sheet before the sheet is fed into the photosensitive drum 8.

Sheets in the sheet supply tray 17 are conveyed one by one along a sheet feed path L1 from the sheet supply tray 17 via the image forming unit 5 to the sheet ejection tray 3A. The sheet ejection tray 3A receives a sheet having an image formed thereon.

An ejection roller 21 is disposed downstream of the fixing unit 11 in the sheet feed direction. The ejection roller 21 is reversible. The ejection roller 21 rotates in a forward direction to eject a sheet toward the sheet ejection tray 3A. The ejection roller 21 rotates in a reverse direction opposite to the forward direction to convey a sheet having passed the fixing unit 11 back toward the photosensitive drum 8 again.

In other words, the image forming apparatus 1 of the embodiment performs printing by selecting a simplex printing mode or a duplex printing mode. The simplex printing mode allows the printing of a sheet on a single side. The duplex printing mode allows the printing of a sheet on both sides. Hereinafter, the ejection roller 21 is also referred to as a switchback roller 21.

When the switchback roller 21 rotates in the forward direction to eject a sheet toward the sheet ejection tray 3A, it is referred that the switchback roller 21 is in a forward rotation mode. When the switchback roller 21 rotates in the reverse direction to convey a sheet back toward the photosensitive drum 8 again, it is referred that the switchback roller 21 is in a reverse rotation mode.

In the duplex printing mode, after an image is formed on a first side of a sheet, the switchback roller 21 reverses the sheet feed direction to feed the sheet toward a re-feed path L2. The re-feed path L2 is a path starting from the switchback roller 21 toward the photosensitive drum 8.

A conveying roller 22 is disposed between the fixing unit 11 and the switchback roller 21 in the sheet feed direction. The conveying roller 22 rotates to convey a sheet ejected from the fixing unit 11 toward the switchback roller 21. The conveying roller 22 is a reversible roller that changes its rotation direction in response to a rotation direction of the switchback roller 21. When the switchback roller 21 rotates in the reverse rotation mode, the conveying roller 22 rotates to convey the sheet fed back from the switchback roller 21 to the re-feed path L2.

The re-feed path L2 branches off from the sheet feed path L1 at a branch portion L3 downstream of the fixing unit 11 in the sheet feed direction, and is connected to the sheet feed path L1 at a junction portion L4 upstream of the registration rollers 19 in the sheet feed direction.

The re-feed path L2 includes a sheet feed path L5 extending from the branch portion L3 to the junction portion L4. The sheet feed path L5 is spaced below the image forming unit 5 including the photosensitive drum 8. A second re-feeding roller 23 and a third re-feeding roller 25 are disposed in the sheet feed path L5.

The second re-feeding roller 23 and the third re-feeding roller 25 are drive rollers to apply a force to a sheet to be conveyed in the sheet path L5. A first re-feeding roller 27 is disposed upstream of the second re-feeding roller 23 in the re-feed path L2.

The first re-feeding roller 27, the second re-feeding roller 23, and the third re-feeding roller 25 are drive rollers to apply a force to a sheet to be re-fed. The switchback roller 21, the first re-feeding roller 27, the second re-feeding roller 23, and the third re-feeding roller 25 rotate by receiving a drive force from a common electric motor (not shown).

The switchback roller 21, the first re-feeding roller 27, the second re-feeding roller 23, and the third re-feeding roller 25 are arranged in this order in a sheet re-feeding direction where a sheet is re-fed from the switchback roller 21.

A turn guide 29 is disposed between the first re-feeding roller 27 and the second re-feeding roller 23. The turn guide 29 turns a sheet being re-fed into a direction crossing a surface of the sheet.

Specifically, the turn guide 29 turns a sheet passing downwardly through the first re-feeding roller 27 into a horizontal direction. The first re-feeding roller 27 is an example of a first drive roller and the second re-feeding roller 23 is an example of a second drive roller according to an aspect of the disclosure.

When at least the switchback roller 21 rotates in the reverse rotation mode, the second re-feeding roller 23 and the third re-feeding roller 25 receive a driving force and rotate. At this time, at least the second re-feeding roller 23 rotates at a peripheral speed greater than the peripheral speed of the first re-feeding roller 27.

Pinch rollers 28A, 28B, 28C, 28D, and 28E are disposed facing the switchback roller 21, the conveying roller 22, the first re-feeding roller 27, the second re-feeding roller 23, and the third re-feeding roller 25, respectively. Each pinch roller 28 presses a sheet against a corresponding roller and is driven by the sheet being re-fed to rotate.

Figure 2:
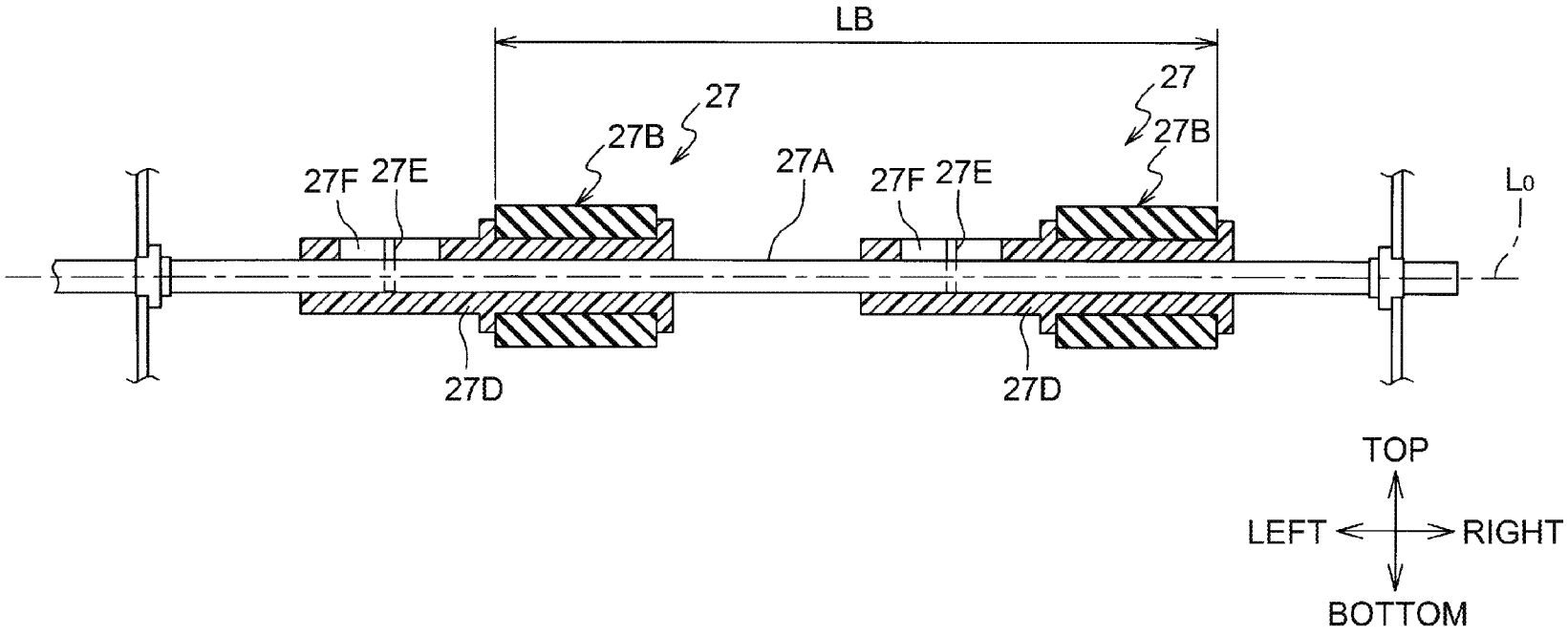
FIG. 2 is a cross sectional view of a first re-feeding roller.

As illustrated in FIG. 2, the first re-feeding roller 27 includes a drive shaft 27A and left and right roller portions 27B. Each roller portion 27B is a cylindrical member and has an outer peripheral surface to contact a sheet.

The drive shaft 27A is inserted into the roller portions 27B and receives a drive force. The embodiment shows that the left roller portion 27B and the right roller portion 27B are identical in structure.

Figure 3A:
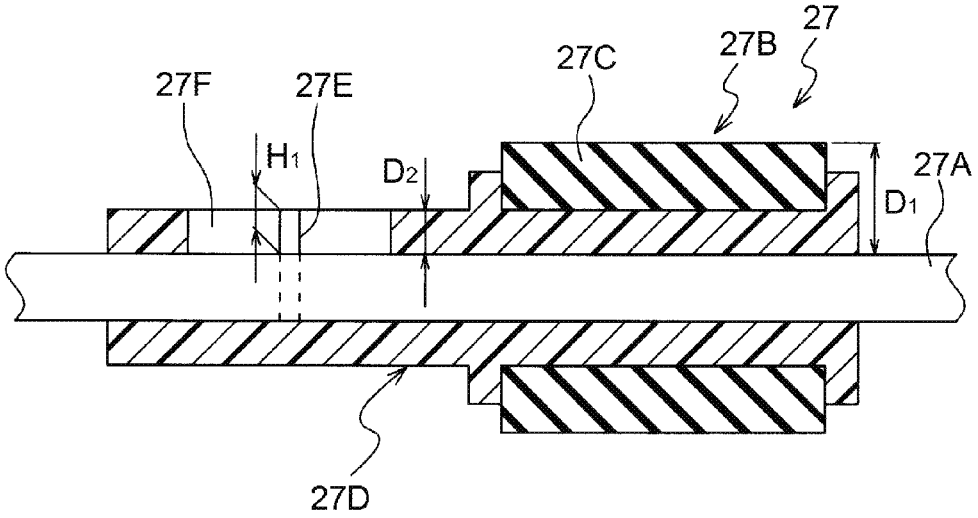
FIG. 3A is a partial cross sectional view of the first re-feeding roller.

The roller portions 27B are spaced from each other along an axis Lo of the drive shaft 27A. As illustrated in FIG. 3A, each roller portion 27B includes a rubber tube 27C and a bobbin 27D.

The rubber tube 27C is made of a rubber material having a relatively high coefficient of friction with a sheet. The rubber tube 27C is a cylindrical member having an outer peripheral surface to contact a sheet. The rubber tube 27C is fitted over an outer peripheral surface of the bobbin 27D. An inner peripheral surface of the bobbin 27D contacts the drive shaft 27A and the bobbin 27D is slidable on the drive shaft 27A.

Thus, each roller portion 27B is movable relative to the drive shaft 27A in a direction of the axis Lo of the drive shaft 27A and a rotation direction R. The embodiment uses the bobbin 27D made of a resin such as Polyoxymethylene (POM) and the drive shaft 27A made of metal with grade SUM 23.

In FIG. 2, the left roller portion 27B and the right roller portion 27B are movable, independently of each other, relative to the drive shaft 27A in the axial direction Lo and the rotation direction R.

In the embodiment, the right roller portion 27B of FIG. 2 is an example of a first roller portion and the left roller portion 27B of FIG. 2 is an example of a second roller portion.

As illustrated in FIG. 2, the drive shaft 27A includes left and right protrusions 27E. Each of the protrusions 27E protrudes from the outer peripheral surface of the drive shaft 27A toward the inner peripheral surface of the bobbin 27D of a corresponding one of the left roller portion 27B and the right roller portion 27B.

As illustrated in FIG. 3A, a protrusion 27E of the embodiment is a cylindrical pin member pressed into the drive shaft 27A. Each bobbin 27D of a corresponding roller portion 27B has a recessed portion 27F at a position where a protrusion 27E is located.

The protrusion 27E has a protruding dimension H1, which is smaller than a thickness dimension D1 of the roller portion 27B. The protruding dimension H1 is smaller than or equal to a thickness dimension D2 of the bobbin 27D. In other words, the protrusion 27E is completely accommodated in the recessed portion 27F.

Figure 3B:
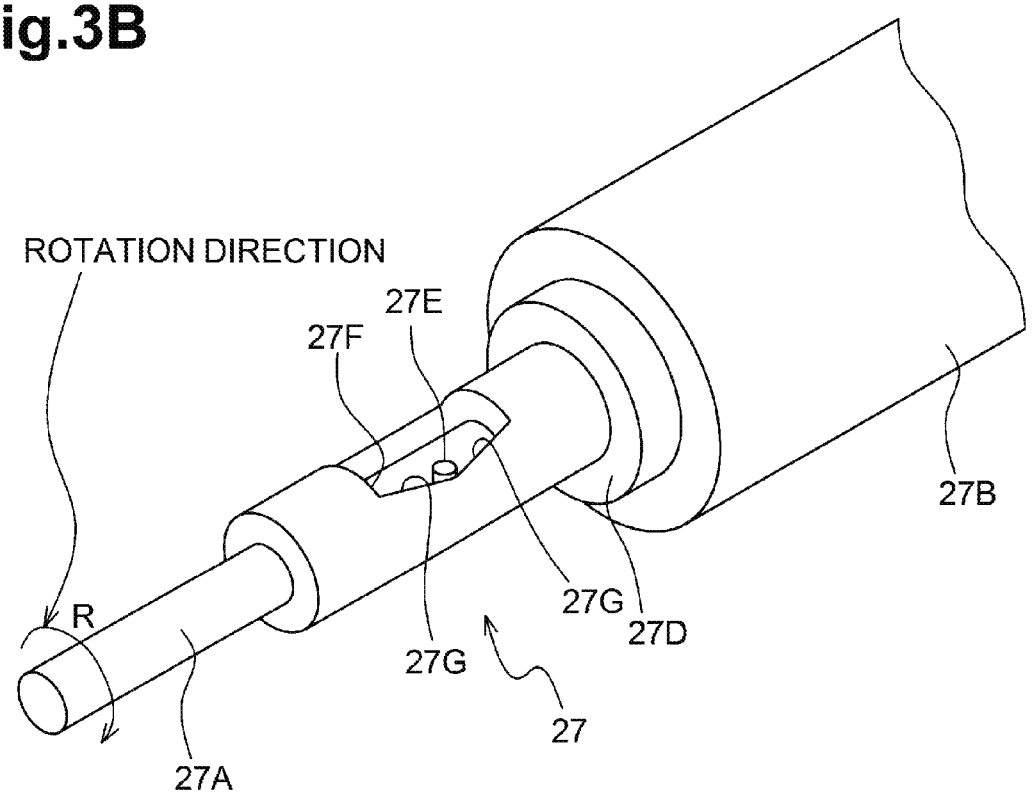
FIG. 3B is a partial perspective view of the first re-feeding roller.

As illustrated in FIG. 3B, the recessed portion 27F is a depressed area in the bobbin 27D. Specifically, the recessed portion 27F is a through hole passing through the bobbin 27D in a direction of thickness. The protrusion 27E is positioned in the through hole. The pin member constituting the protrusion 27E is press-fitted into the drive shaft 27A after the drive shaft 27A is inserted into the roller portion 27B.

Figure 4:
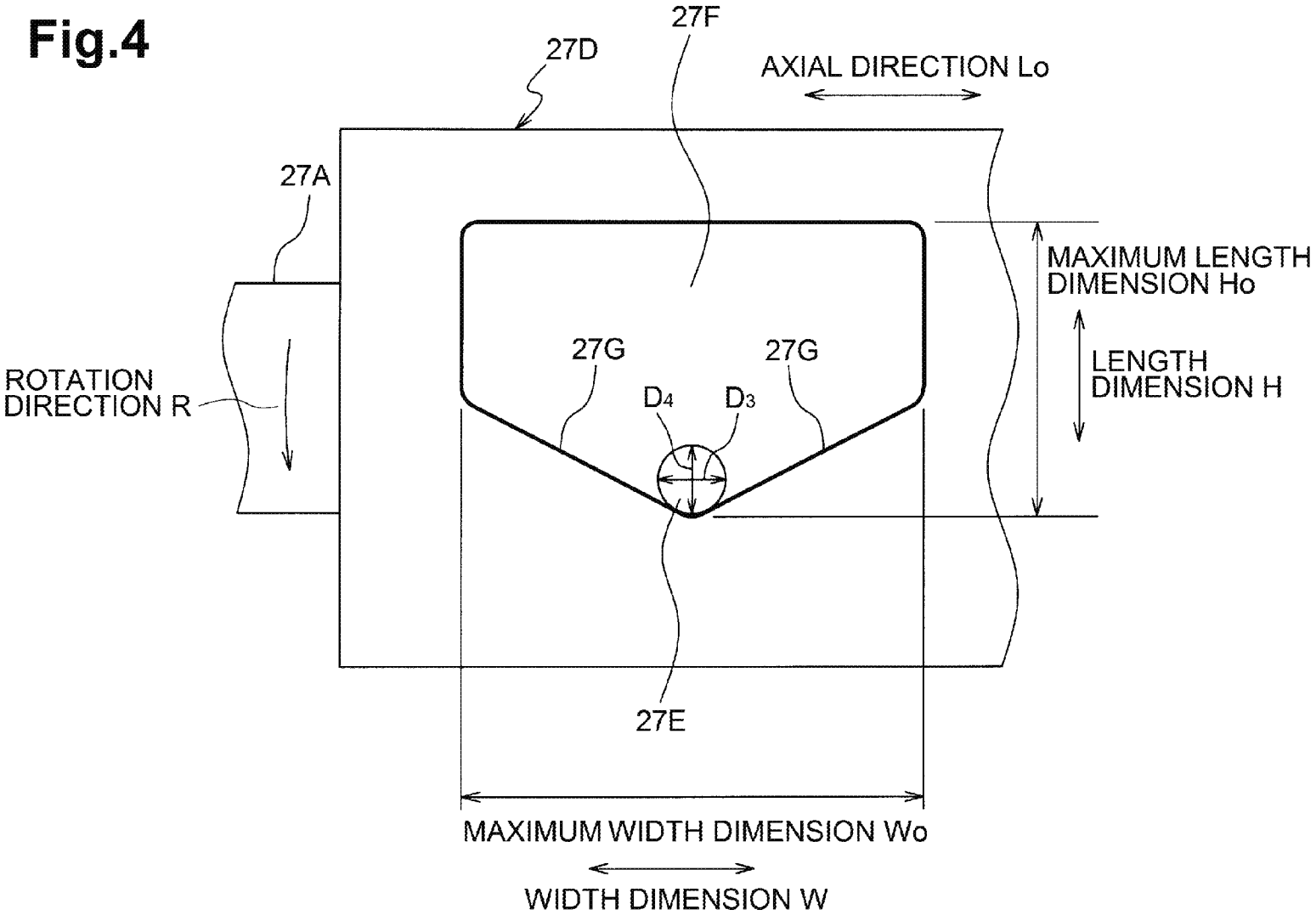
FIG. 4 illustrates a recessed portion of a drive shaft, which is projected on an imaginary plane parallel to an outer peripheral surface of the drive shaft.

As illustrated in FIG. 4, the recessed portion 27F includes a peripheral wall that defines an opening of the hole. The peripheral wall includes cam surfaces 27G at a forward portion of the peripheral wall in the rotation direction R. The cam surfaces 27G are configured to contact a side surface of the protrusion 27E. The opening has a width dimension becoming smaller toward the forward side in the rotation direction R. Thus, each of the cam surfaces 27G is inclined toward the forward side in the rotation direction R.

The opening of each recessed portion 27F has the maximum width dimension Wo, which is greater than a width dimension D3, which is parallel to the axial direction Lo, of the protrusion 27E. Further, the opening of each recessed portion 27F has the maximum length dimension Ho, which is greater than the length dimension D4, which is parallel to the rotational direction R, of the protrusion 27E.

As the protrusion 27E of the embodiment is cylindrical, the width dimension D3 and the length dimension D4 are the diameter dimension of the protrusion 27E.

The width dimension W of the opening refers to, when projected on an imaginary plane parallel to the outer peripheral surface of the drive shaft 27A, a dimension of the opening of each recessed portion 27F measured in the axial direction of the drive shaft 27A. The length dimension H of the opening refers to, when projected on the imaginary plane, a dimension of the opening of each recessed portion 27F measured in the rotation direction of the drive shaft 27A.

Parenthetically, the imaginary plane is a curved surface. FIG. 4 is a plan view of the recessed portion 27F projected on the imaginary plane, which is a curved surface. In FIG. 4, the peripheral wall of the recessed portion 27F defining the opening is indicated by thick solid line.

The recessed portion 27F has the maximum length dimension Ho at a middle portion of the recessed portion 27F in the axial direction. The middle portion of the recessed portion 27F in the axial direction corresponds to a middle portion of three substantially equal parts into which the recessed portion 27F extending in the direction of the width dimension W is divided.

Each cam surface 27G slopes and thus has a constant rate of change of the width dimension W relative to the rotation direction R. Namely, on each cam surface 27G, the length dimension H changes linearly (straightly) at each position in the axial direction. In other words, the cam surfaces 27G in FIG. 4 correspond to oblique sides of a triangle whose base is parallel to the axial direction.

In the embodiment, the portion of the opening of each recessed portion 27G having the maximum length dimension Ho is located at the middle portion of the recessed portion 27G. Thus, in FIG. 4, the cam surfaces 27G correspond to oblique sides (two sides of equal length) of an isosceles triangle whose base is parallel to the axial direction.

Further, a portion of the opening of the recessed portion 27F having the maximum width dimension Wo extends over a specified range. Thus, the peripheral wall of the recessed portion 27F indicate a shape of the opening which is symmetric with respect to the portion of the opening of the recessed portion 27F having the maximum length dimension Ho. The recessed portion 27F is shaped like a pentagon, for example, a baseball home plate.

The image forming apparatus 1 of the embodiment uses the first re-feeding roller 27 and the second re-feeding roller 23 which constitute a sheet feeding apparatus.

When a sheet contacts the pair of roller portions 27B of the first re-feeding roller 27 but does not contact the second re-feeding roller 23, as illustrated in FIG. 4, each protrusion 27E contacts the cam surfaces 27G of the recessed portion 27E and thus engages the recessed portion 27F. Thus, the sheet receives a feeding force from the first re-feeding roller 27 and is fed toward the second re-feeding roller 23.

When a sheet contacts the pair of roller portions 27B of the first re-feeding roller 27 and the second re-feeding roller 23, the feeding speed of the sheet substantially agrees with the peripheral speed of the second re-feeding roller 23. In other words, when the sheet contacts the first re-feeding roller 27 and the second re-feeding roller 23, the sheet is fed as it is drawn by the second re-feeding roller 23 having a greater peripheral speed.

Figure 5:
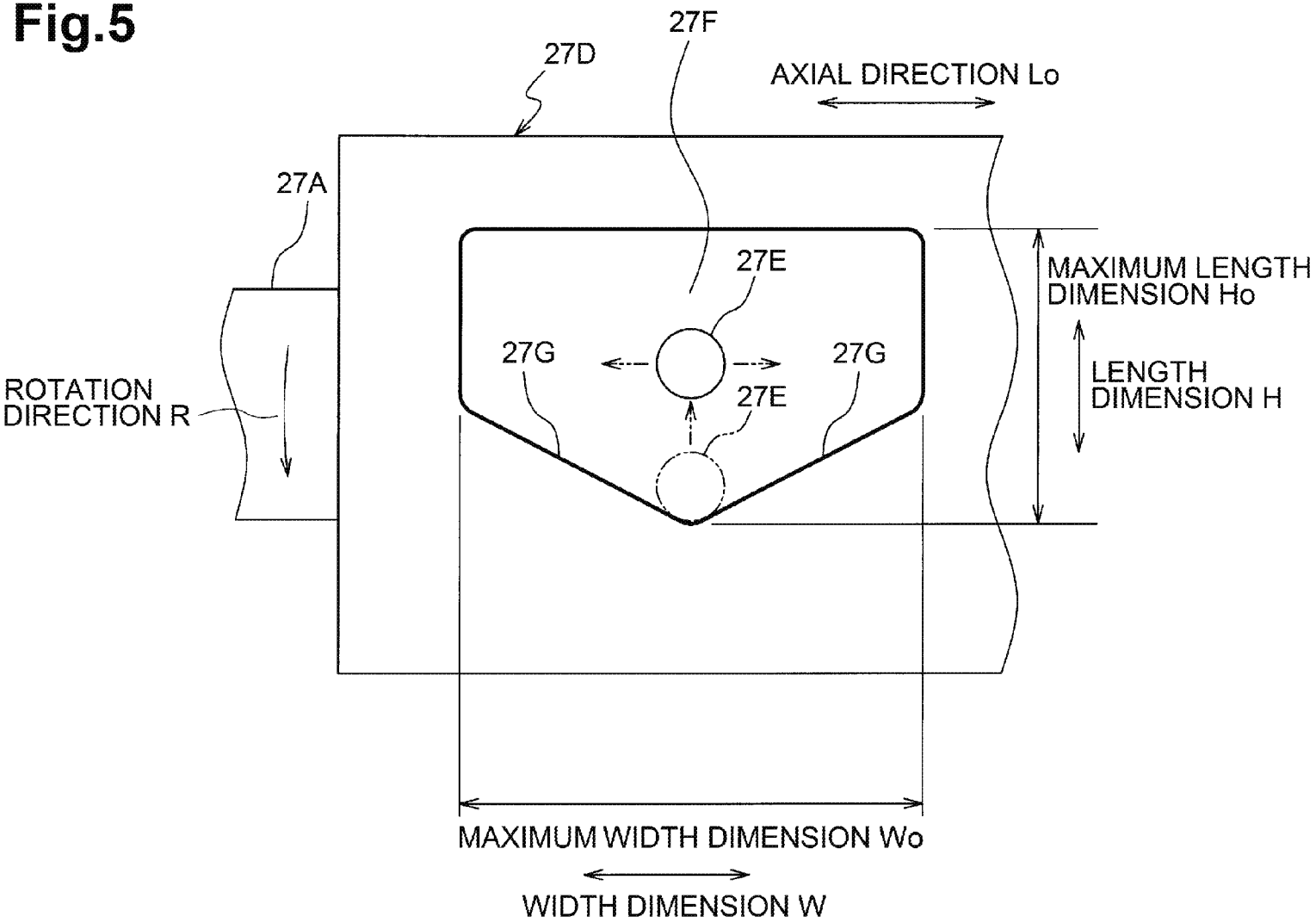
FIG. 5 illustrates a positional relationship between the recessed portion and a protrusion.

At this time, as illustrated in FIG. 5, the protrusion 27E is separated from the cam surfaces 27G as the pair of roller portions 27B of the first re-feeding roller 27 is movable relative to the drive shaft 27A in the axial direction Lo and the rotation direction R. The pair of roller portions 27B moves in the axial direction Lo while rotating along with the feeding of the sheet.

Figure 6:
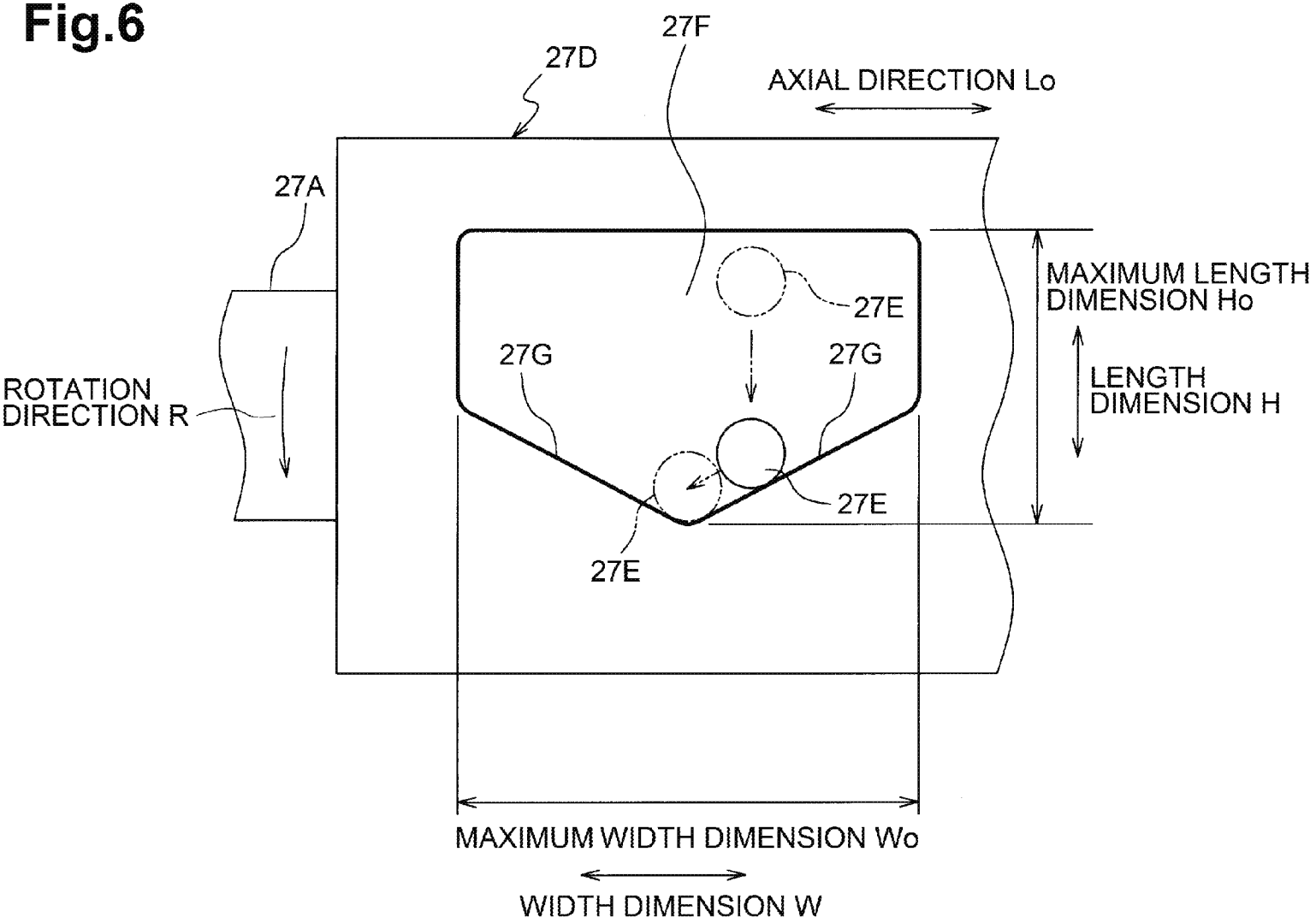
FIG. 6 illustrates a positional relationship between the recessed portion and the protrusion.

When the drive shaft 27A rotates in a state where a sheet does not contact the pair of roller portions 27B of the first re-feeding roller 27 and the second re-feeding roller 23 or in a state where a sheet contacts the pair of the roller portions 27B of first re-feeding roller 27 but does not contact the second re-feeding roller 23, as illustrated in FIG. 6, each protrusion 27E moves relative to a corresponding one of the roller portions 27B in the rotation direction R and contacts the cam surface 27G.

The cam surfaces 27G are inclined to the axial direction Lo and a tangent to the peripheral surface of the drive shaft 27A as the opening has a width dimension W becoming smaller toward the forward side in the rotation direction R.

When the drive shaft 27A rotates in a state where the protrusion 27E contacts a cam surface 27G, the protrusion 27E slides on the cam surface 27G toward a portion of the opening of the recessed portion 27F having the smallest width dimension W.

In other words, when the drive shaft 27A rotates in a state where a sheet does not contact the second re-feeding roller 23 yet, the protrusion 27E automatically slides on the cam surface 27G to the portion of the opening of the recessed portion 27F having the smallest width dimension W, and remains in the portion of the opening of the recessed portion 27F having the smallest width dimension W to transmit a drive force to the pair of roller portions 27B. This structure reduces fluctuations of the movement of the first re-feeding roller 27 in the rotation direction and the axial direction.

The embodiment shows that the roller portions 27B arranged in the axial direction of the drive shaft 27A are movable, independently of each other, relative to the drive shaft 27A in the axial direction and the rotation direction. Thus, this structure appropriately reduces fluctuations of the movement of the roller portions 27B in the axial direction Lo and the rotation direction R.

The embodiment shows that the recessed portion 27F of each roller portion 27B has the maximum length dimension Ho at a middle portion of the opening of the recessed portion 27F in the axial direction. Thus, each roller portion 27B is movable relative to a corresponding protrusion 27E in directions toward both ends of the drive shaft 27A in the axial direction.

If one of the cam surfaces 27G corresponds to the oblique side (hypotenuse) of a right-angled triangle whose base is parallel to the axial direction Lo, the roller portion 27B can move in one direction only toward one end of the drive shaft 27A in the axial direction, but cannot move in the other direction toward the other end of the drive shaft 27A.

The embodiment shows that, in the recessed portion 27F of each roller portion 27B, the rate of change of the width dimension W relative to the rotation direction is constant at least at the cam surfaces 27G. Thus, the cam surfaces 27G are shaped simply, which facilitates forming of the recessed portion 27F.

The embodiment shows that the drive shaft 27A includes the protrusion 27E, the roller portion 27B includes the recessed portion 27F, and the protruding dimension H1 of the protrusion 27E is smaller than the thickness dimension D1 of the roller portion 27B. This structure reduces the protrusion 27E from contacting a sheet being fed, which obviates improper sheet feeding.

The embodiment shows the sheet feed path, which extends from the first re-feeding roller 27 (first drive roller) to the second re-feeding roller 23 (second drive roller), has a curved portion curving in a direction orthogonal to the surface of a sheet being fed.

Sheets are liable to be skewed while being fed through any curved portion of the sheet feed path, which is sandwiched between the drive rollers. Thus, it is effective when the embodiment is applied to a sheet feeding apparatus including drive rollers disposed at the leading side and the trailing side of a curved portion of a sheet feed path, and to an image forming apparatus including the sheet feeding apparatus.

A second embodiment will be described with reference to FIGS. 7 and 8.

It is noted that, in the second embodiment, elements similar to or identical with those shown and described in the above first embodiment are designated by similar numerals, and thus the description thereof can be omitted for the sake of brevity.

The first embodiment shows that the first re-feeding roller 27, the second re-feeding roller 23, and the third re-feeding roller 25 are positioned stationary relative to the casing 3, and more specifically, the second re-feeding roller 23 and the third re-feeding roller 25 are positioned stationary relative to the first re-feeding roller 27.

Figure 7:
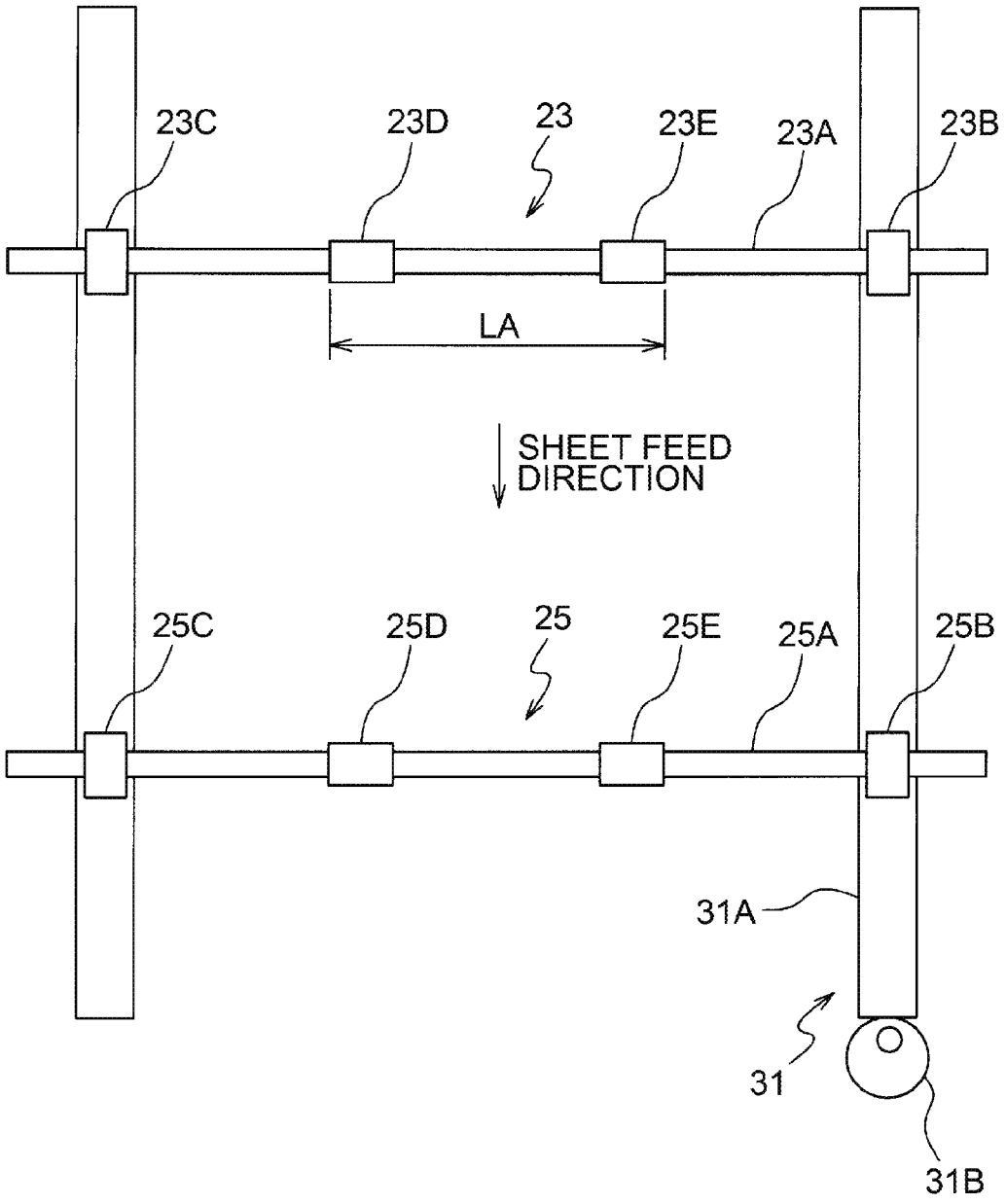
FIG. 7 illustrates a changing mechanism of the image forming apparatus according to a second embodiment.
Figure 8:
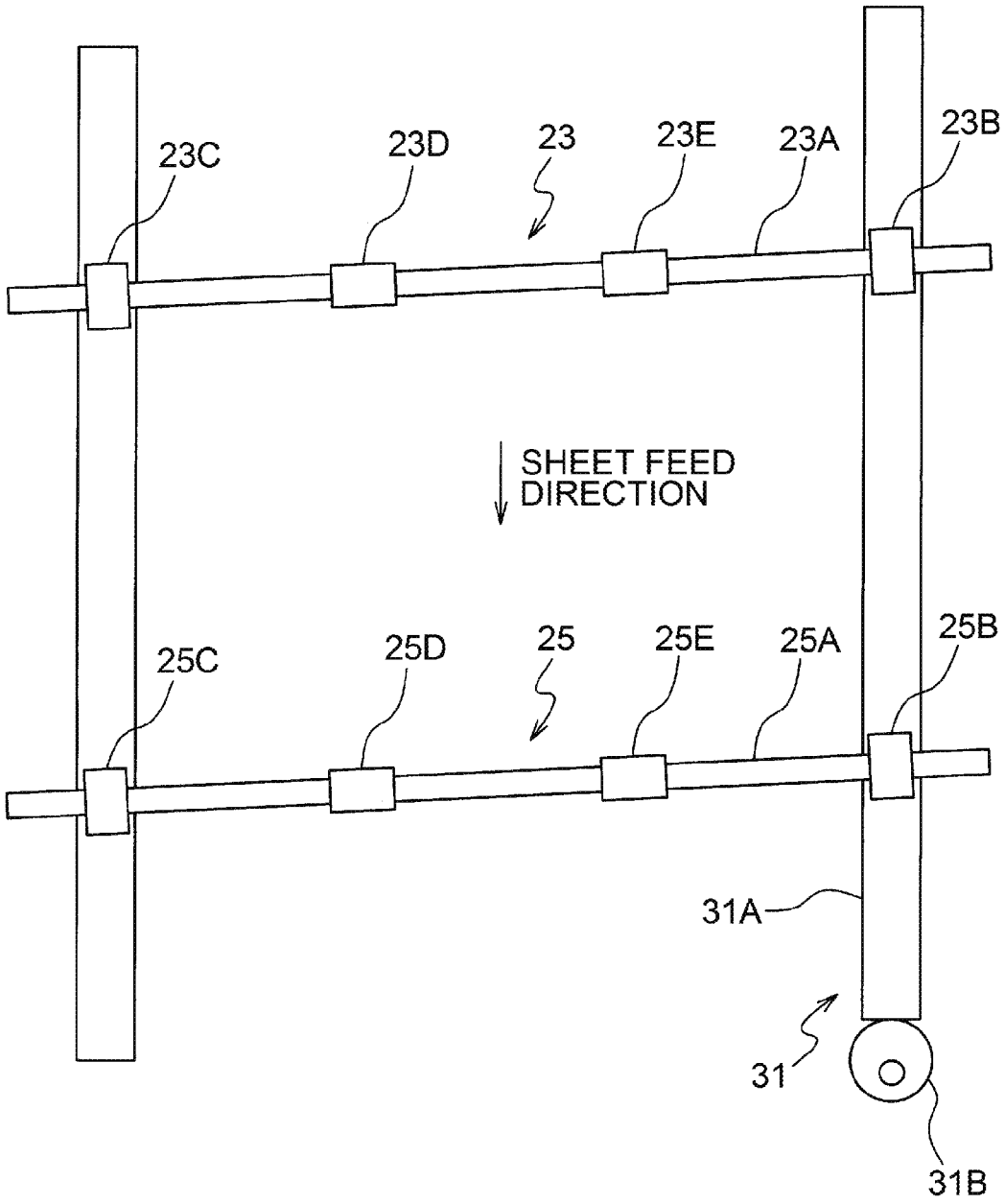
FIG. 8 illustrates the changing mechanism of the image forming apparatus.
Figure 9B:
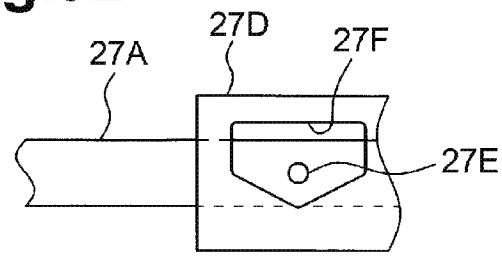
FIGS. 9A, 9B, 9C, and 9D illustrate a structure of a first re-feeding roller according to a third embodiment.
Figure 9A:
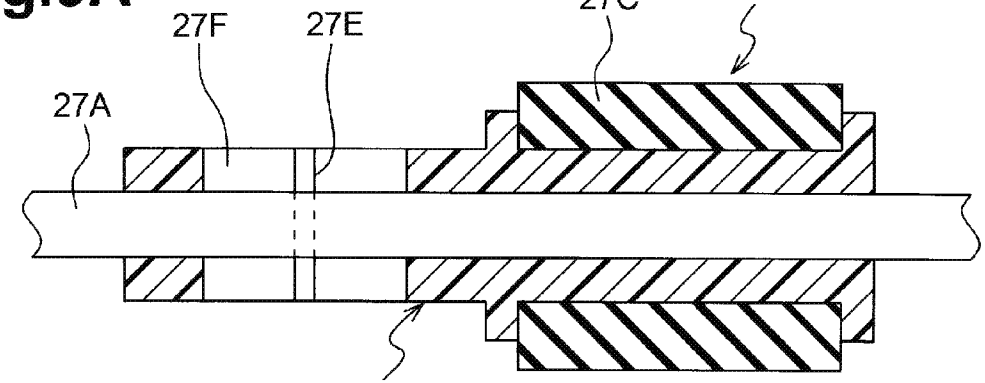
Figure 9C:
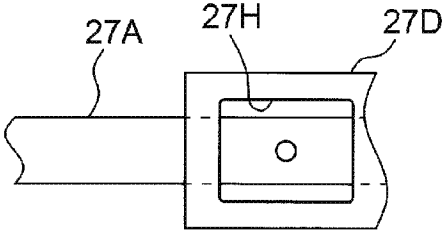
Figure 9D:
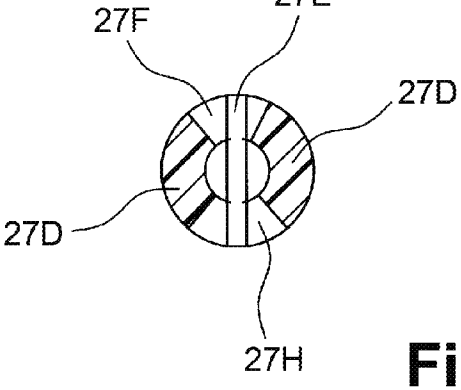

As illustrated in FIG. 7, the second embodiment includes a changing mechanism 31 disposed below the image forming unit 5. The changing mechanism 31 is configured to change an angle of inclination of an axis of the second re-feeding roller 23 relative to the axis of the first re-feeding roller 27.

In the second embodiment, the second re-feeding roller 23, the third re-feeding roller 25, and the changing mechanism 31 are assembled to a re-feeding unit (not shown). The re-feeding unit has a shape like a tray and is detachably attached to the casing 3.

The changing mechanism 31 includes a link 31A and an eccentric cam 31B. The link 31A is disposed to one end of each of the drive shaft 23A of the second re-feeding roller 23 and the drive shaft 25A of the third re-feeding roller 25 in their axial direction.

The link 31A has bearing portions 23B, 25B assembled thereto. The bearing portions 23B, 25B rotatably support one end portions of the drive shaft 23A and the drive shaft 25A, respectively. The link 31A is movable relative to the re-feeding unit in a direction orthogonal to the axial direction of the drive shafts 23A and 25A.

The eccentric cam 31B is a circular disk, which is rotatable about an axis off-center. The outer peripheral surface of the eccentric cam 31B is configured to contact an end of the link 31A in the longitudinal direction of the link 31A. The rotation axis of the eccentric cam 31B is stationary to the re-feeding unit.

Bearing portions 23C and 25C rotatably supporting the other end portions of the drive shafts 23A and 25A, respectively, opposite to the bearing portions 23B and 25B, are stationary to the re-feeding unit. As illustrated in FIG. 8, when the eccentric cam 31B rotates, the link 31A moves in the longitudinal direction in response to the rotation angle of the eccentric cam 31B.

The second re-feeding roller 23 and the third re-feeding roller 25 move together in response to the movement of the link 31A, and thus an angle of inclination of each axis of the second and third re-feeding rollers 23 and 25 relative to the axis of the first re-feeding roller 27 changes. In the second embodiment, the user removes the re-feeding unit from the casing 3, and then rotates the eccentric cam 31B to adjust the angle of inclination of each of the second and third re-feeding rollers 23 and 25.

As illustrated in FIG. 7, the second re-feeding roller 23 of the second embodiment includes two roller portions 23D, 23E, which are spaced in the axial direction of the second re-feeding roller 23. A dimension measured in the axial direction from left end of the roller portion 23D to the right end of the roller portion 23E is referred to as dimension LA. A sheet contacts the second re-feeding roller 23 by the dimension LA.

The dimension LA of the second re-feeding roller 23 is greater than a dimension LB (FIG. 2) of the first re-feeding roller 27. As illustrated in FIG. 2, the dimension LB is a dimension measured in the axial direction from the left end of the left roller portion 27B to the right end of the right roller portion 27B.

If the second re-feeding roller 23 has only the roller portion 23D, the dimension LA will be an axial dimension of the roller portion 23D. In the second embodiment, the second re-feeding roller 23 and the third re-feeding roller 25 are identical in structure. The third re-feeding roller 25 includes two roller portions 25D, 25E, which are spaced in the axial direction of the third re-feeding roller 25 by the same distance as the roller portions 23D, 23E of the second re-feeding roller 23.

If the first re-feeding roller 27 has only one roller portion 27B, the dimension LB of the first re-feeding roller 27 in the axial direction will be an axial dimension of the rubber tube 27C of the roller portion 27B.

In the second embodiment, the dimension LA of the second re-feeding roller 23 in the axial direction is greater than the dimension LB of the first re-feeding roller 27 in the axial direction. This structure promptly reduces the possibility of a sheet skew if the sheet is skewed as it is being fed.

In other words, the dimension LB means the length of a portion of a sheet to be held by the first re-feeding roller 27 and the pinch roller 28B. The dimension LA means the length of a portion of a sheet to be held by the second re-feeding roller 23 and the pinch roller 28D.

The length of a portion of a sheet to be held by the upstream rollers is less than the length of a portion of the sheet to be held by the downstream rollers. In other words, a force exerted on an upstream side of a sheet is less than a force exerted on a downstream side of the sheet.

This structure enables the upstream side of the sheet to move in the axial direction together with the roller portions 27B, and promptly reduces skewing of the sheet being fed.

The second embodiment includes the changing mechanism 31 for changing an angle of inclination of the second re-feeding roller 23 relative to the axial direction of the first re-feeding roller 27. The use of the changing mechanism 31 facilitates adjustment of the amount of skew during re-feeding of sheets, which varies among the individual image forming apparatuses 1.

A third embodiment will be described with reference to FIGS. 9A, 9B, 9C, and 9D.

It is noted that, in the third embodiment, elements similar to or identical with those shown and described in the above embodiments are designated by similar numerals, and thus the description thereof can be omitted for the sake of brevity.

As illustrated in FIGS. 9A to 9D, the third embodiment uses a cylindrical pin member constituting a protrusion 27E, which is press-fitted through the drive shaft 27A in a direction orthogonal to the axial direction. Thus, the bobbin 27D of a roller portion 27B has a recessed portion 27H on a side opposite to the recessed portion 27F to avoid collision of the pin member passing through the drive shaft 27A and the roller portion 27B.

The recessed portion 27H is formed with an opening greater in size than the opening of the recessed portion 27F. The recessed portion 27H is a through hole passing through the bobbin 27D from the inner peripheral surface of the bobbin 27D toward the outer peripheral surface of the bobbin 27D. Other structures are similar to those in the above first and second embodiments.

The above embodiments show but are not limited to that the recessed portions 27F and 27H are through holes passing through the bobbin 27D from the inner peripheral surface of the bobbin 27D toward the outer peripheral surface of the bobbin 27D. The recessed portions may be recessed from the inner peripheral surface of the bobbin toward the outer peripheral surface of the bobbin.

The above embodiments show but are not limited to that the roller portions 27B of the first re-feeding roller 27, which are arranged in the axial direction of the drive shaft 27A, are movable, independently of each other, relative to the drive shaft 27A in the axial direction and the rotation direction.

The first re-feeding roller may have a single roller portion only. Alternatively, the first re-feeding roller may have plural roller portions which may be movable together in the axial direction and the rotation direction.

The above embodiments show but are not limited to that the recessed portion 27F has the maximum length dimension Ho at a middle portion of the recessed portion 27F in the axial direction. The recessed portion may have a cam surface corresponding to the oblique side of a right-angled triangle whose base is parallel to the axial direction. Alternatively, the recessed portion may have the maximum length dimension off the middle portion of the recessed portion in the axial direction.

The above embodiments show but are not limited to the recessed portion 27F of each roller portion 27B in which the rate of change in the width dimension W relative to the rotation direction is constant at least at the cam surfaces 27G. The rate of change may not be constant, or the cam surfaces may be curved surfaces.

The above embodiments show but are not limited to that the drive shaft 27A includes the protrusion 27E, the roller portion 27B includes the recessed portion 27F, and the protruding dimension H1 of the protrusion 27E is smaller than the thickness dimension D1 of the roller portion 27B.

If the protrusion 27E is positioned off the width of the sheet feed path, the protruding height H1 of the protrusion 27E may be greater than or equal to the thickness dimension D1 of the roller portion 27B.

The above embodiments show but are not limited to that the sheet feed path from the first re-feeding roller 27 to the second feeding roller 23 is curved in a direction crossing the surface of a sheet being fed. The sheet feed path may not be curved.

The above embodiments show but are not limited to that the pin member constituting the protrusion 27E is press-fitted into the drive shaft 27A after the drive shaft 27A is inserted into the roller portion 27B or the bobbin 27D. The protrusion 27E may be formed integrally with the drive shaft 27A.

The above embodiments show but are not limited to that the protrusion 27E is cylindrical in shape and circular in cross section. The protrusion 27E may be oval in cross section.

The above embodiments show but are not limited to that the drive shaft 27A includes the protrusions 27E and the roller portion 27B includes the recessed portion 27F. The drive shaft 27A may include the recessed portion 27E, and the roller portion 27B may include the protrusion 27E.

What is claimed is:

1. A sheet feeding apparatus configured to feed a sheet, comprising:

a first drive roller configured to apply a feeding force to the sheet, the first drive roller including:

a drive shaft configured to receive a drive force and rotate; and a roller portion having a cylindrical shape and fitted over the drive shaft, the roller portion being configured to contact the sheet, the roller portion being movable relative to the drive shaft in an axial direction and a rotation direction of the drive shaft;

a second drive roller disposed downstream of the first drive roller, the second drive roller being configured to apply a feeding force to the sheet and rotate at a peripheral speed greater than a peripheral speed of the first drive roller; and a changing mechanism configured to change an angle of inclination of an axis of the second drive roller relative to an axis of the first drive roller, wherein one of the drive shaft and the roller portion of the first drive roller includes a protrusion protruding toward the other one of the drive shaft and the roller portion, wherein the other one of the drive shaft and the roller portion of the first drive roller includes a recessed portion, the recessed portion including a peripheral wall that defines an opening such that the protrusion is positioned in the opening, wherein the peripheral wall of the recessed portion includes a cam surface at a forward portion of the peripheral wall in the rotation direction, the cam surface being configured to contact a side surface of the protrusion, wherein the opening of the recessed portion has a width, parallel to the axial direction, which becomes smaller toward the forward portion of the peripheral wall in the rotation direction, wherein the maximum width of the opening is greater than a width, parallel to the axial direction, of the protrusion, and wherein the maximum length, parallel to the rotation direction, of the opening is greater than a length, parallel to the rotation direction, of the protrusion.

2. The sheet feeding apparatus according to claim 1, wherein the opening of the recessed portion has the maximum length at a middle portion of the recessed portion in the axial direction.

3. The sheet feeding apparatus according to claim 1, wherein the cam surface has a constant rate of change of the width relative to the rotation direction.

4. The sheet feeding apparatus according to claim 1, wherein the drive shaft includes the protrusion and the roller portion includes the recessed portion, and wherein the protrusion of the drive shaft has a protruding dimension less than a thickness dimension of the roller portion.

5. The sheet feeding apparatus according to claim 1, further comprising a turn guide disposed between the first drive roller and the second drive roller, the turn guide being configured to turn the sheet being fed from the first drive roller into a direction crossing a surface of the sheet.

6. The sheet feeding apparatus according to claim 1, wherein the first drive roller includes a further roller portion having a cylindrical shape, the further roller portion being fitted over the drive shaft and spaced from the roller portion in the axial direction, wherein the second drive roller includes a second drive shaft and a first roller portion and a second roller portion, which are fitted over the drive shaft and spaced apart from each other in an axial direction of the drive shaft of the second drive roller, the first roller portion and the second roller portion being configured to contact the sheet, and wherein a dimension of the second drive roller measured in the axial direction of the second drive shaft from one end of the first roller portion to one end of the second roller portion is greater than a dimension of the first drive roller measured in the axial direction of the drive shaft from one end of the roller portion to one end of the further roller portion, one end of the first roller portion being closer to one end of the second drive shaft than one end of the second roller portion, one end of the roller portion being closer to one end of the drive shaft than one end of the further roller portion.

7. The sheet feeding apparatus according to claim 1, wherein the first drive roller includes a further roller portion having a cylindrical shape and fitted over the drive shaft, and wherein the roller portion and the further roller portion are spaced from each other in the axial direction and are movable independently of each other relative to the drive shaft in the axial direction and the rotation direction.

8. The sheet feeding apparatus according to claim 1, wherein the cam surface of the recessed portion corresponds to an oblique side of a triangle whose base is parallel to the axial direction.

9. The sheet feeding apparatus according to claim 1, wherein the recessed portion is shaped like a baseball home plate.

10. An image forming apparatus comprising:

a sheet feeding apparatus configured to feed a sheet, the sheet feeding apparatus including:

a first drive roller including a drive shaft and a roller portion having a cylindrical shape and fitted over the drive shaft, the roller portion being configured to contact the sheet, the roller portion being movable relative to the drive shaft in an axial direction and a rotation direction of the drive shaft;

a second drive roller disposed downstream of the first drive roller and configured to rotate at a peripheral speed greater than a peripheral speed of the first drive roller; and a changing mechanism configured to change an angle of inclination of an axis of the second drive roller relative to an axis of the first drive roller; and an image forming unit configured to form an image on a sheet fed by the sheet feeding apparatus, wherein one of the drive shaft and the roller portion of the first drive roller includes a protrusion protruding toward the other one of the drive shaft and the roller portion, wherein the other one of the drive shaft and the roller portion of the first drive roller includes a recessed portion, the recessed portion including a peripheral wall that defines an opening such that the protrusion is positioned in the opening, wherein the peripheral wall of the recessed portion includes a cam surface at a forward portion of the peripheral wall in the rotation direction, the cam surface being configured to contact a side surface of the protrusion, wherein the opening of the recessed portion has a width, parallel to the axial direction, which becomes smaller toward the forward portion of the peripheral wall in the rotation direction, wherein the maximum width of the opening is greater than a width, parallel to the axial direction, of the protrusion, and wherein the maximum length of the opening parallel to the rotation direction is greater than a length, parallel to the rotation direction, of the protrusion.

* * * * *